US005227214A

United States Patent [19]

Kerr et al.

[11] Patent Number: 5,227,214

[45] Date of Patent: Jul. 13, 1993

[54] ANTI-CREEP MAT

[75] Inventors: Robert C. Kerr; John H. Murray, both of Lagrange, Ga.

[73] Assignee: Milliken Research Corporation, Spartanburg, S.C.

[21] Appl. No.: 858,642

[22] Filed: Mar. 27, 1992

[51] Int. Cl.[5] ..... D03D 27/00; A47L 17/08; B32B 33/00

[52] U.S. Cl. ..... 428/95; 428/85; 15/217; 15/238

[58] Field of Search ..... 428/85, 95; 15/217, 15/238

[56] References Cited

U.S. PATENT DOCUMENTS

| | | | |
|---|---|---|---|
| D. 83,113 | 1/1931 | Lepke | D6/582 |
| D. 90,510 | 5/1933 | Schwartz | D6/582 |
| 2,477,960 | 8/1949 | Caldwell | 15/215 |
| 2,512,310 | 6/1950 | Corson | 15/215 |
| 2,667,654 | 2/1954 | Peterson | 15/238 |
| 3,578,738 | 5/1971 | Hughes | 15/215 |
| 3,648,320 | 3/1972 | Wooley | 15/215 |
| 4,010,301 | 3/1977 | Anderson et al. | 428/95 |
| 4,707,895 | 11/1987 | Lang | 428/95 |
| 4,731,255 | 3/1988 | Andersen | 428/95 |
| 4,741,065 | 5/1988 | Parkins | 15/217 |
| 4,886,692 | 12/1989 | Kerr et al. | 428/95 |
| 4,917,932 | 4/1990 | McClang | 428/95 |

FOREIGN PATENT DOCUMENTS

| | | | |
|---|---|---|---|
| 3243803 | 6/1984 | Fed. Rep. of Germany . | |
| 2328431 | 5/1977 | France | 15/215 |
| 2544659 | 10/1984 | France | 15/215 |
| 220945 | 10/1986 | Japan | 296/97.23 |
| 254437 | 10/1989 | Japan . | |

*Primary Examiner*—George F. Lesmes
*Assistant Examiner*—Terrel Morris
*Attorney, Agent, or Firm*—Earle R. Marden; Terry T. Moyer

[57] ABSTRACT

A cleated dust control mat having a plurality of rows of elliptical cleats located at an angle to the border of the mat with the cleats in each row being parallel to the other cleats in the row and being substantially perpendicular to the cleats in the next adjacent rows of cleats. A second set of small circular cleats is located between the elliptical cleats in each row equally spaced from adjacent elliptical cleats in each row.

9 Claims, 1 Drawing Sheet

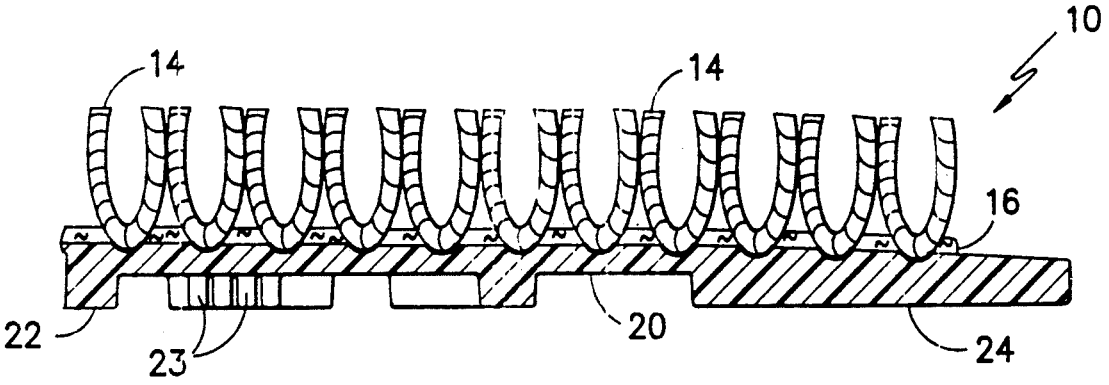
FIG. — 1 —
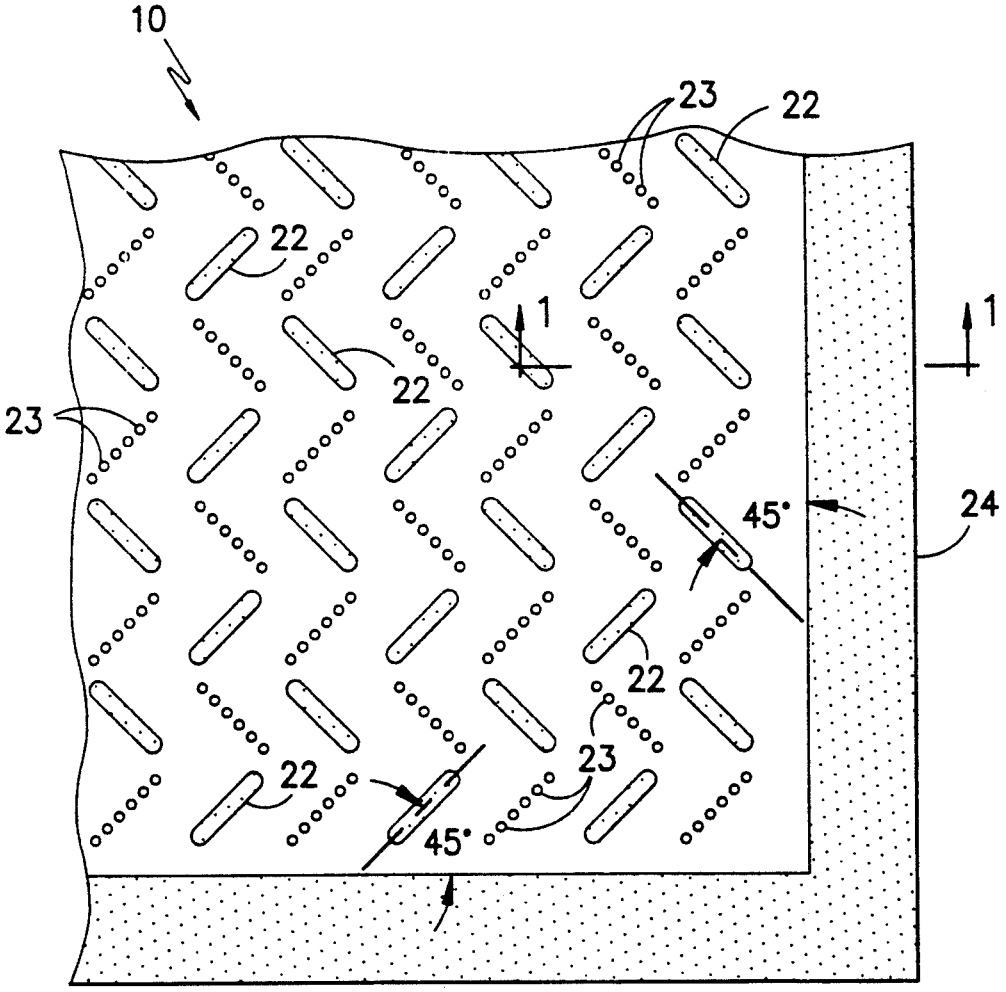
FIG. — 2 —

ANTI-CREEP MAT

This invention relates generally to rubber-backed dust control floor mats of the type which have a pile surface on one side and a rubber or rubber-like material on the other side. Mats of this type are generally used in access ways where people tend to brush or scrape their feet in order to prevent carrying of moisture and/or dirt, accumulated on their footwear, into other areas of the premises. Normally these mats are located in areas of high pedestrian traffic, such as doorways.

In recent years certain dust control mats, such as that shown in U.S. Pat. No. 4,741,065, have been molded with cleats on the bottom surface thereof to prevent walking or creeping of the mats when placed on a surface to be protected. Various types, shapes and arrangements of cleats have been used that have provided anti-creep properties but have also had problems associated therewith. Most of the cleats involved have been very small and a large number of these cleats are spaced throughout the back of the mat. This created problems in molding since the molding pads used to produce the patterns have been difficult and costly to manufacture and subject to tearing and shortened service life due to the large number of holes required in the pad to allow the rubber to be extruded therethrough to produce the cleats during vulcanization. Furthermore, the dust control mat with a large number of small cleats on the back thereof caused an excessive amount of linting during processing in the washwheels due to the loss of pile fiber from the face of the mats.

Therefore, it is an object of the invention to provide a dust control mat with a new and improved cleat arrangement on the back surface thereof.

Other objects and advantages of the invention will become readily apparent as the specification proceeds to describe the invention with reference to the accompanying drawings, in which:

FIG. 1 is a cross-section view of the new and improved dust control mat taken on line 1—1 of FIG. 2, and FIG. 2 is partial view of the new improved dust control mat showing the new cleats and the arrangement thereof.

In the preferred form of the invention the mats 10 consist of pile yarns 14 of nylon, cotton, polyester, etc. tufted through a woven or nonwoven substrate 16 of suitable material with the bottom 18 of the tufts adhered to the rubber or rubber-like backing 20 during vulcanization. Molded integral with or otherwise secured to the bottom of the backing 20 are a plurality of anti-creep cleats 22 and 23. Each of the mats commonly have a border portion 24 therearound.

The cleats 22 are elliptical shaped with the length of the major axis thereof being substantially longer than the length of the minor axis. In other words the length of the cleat 22 is substantially longer than the width thereof on the order of 5 to 1. In the preferred form of the invention the floor or surface engaging surface of the cleat is rough ended or pebbled to increase the resistance to friction thereof.

As shown in FIG. 2 all the cleats in any one row are parallel to one another and substantially perpendicular to the cleats 22 in the next adjacent rows. Preferably the major axis of each cleat forms an angle of approximately 45° to the border portion 24. It can be seen that the cleats 22 are widely spaced one from the other with approximately two cleats per 4 square inches of back mat surface.

The cleats 23 in each row lie in a plane which is substantially parallel to the adjacent cleats 22 in the row and spaced equally distant therefrom. In the preferred form of the invention there are six substantially circular cleats 23 in each line between the cleats 22 but such number is only preferred and other numbers of cleats 23 may be used, if desired. This limited number of circular cleats 23 in the arrangement shown maintains a high resistance to mat creep when placed over looped pile type carpets when the individual circular cleat diameters do not exceed 3/32 inch. As can readily be seen, the plane passing through the circular cleats 23 in each set is at an angle approximately equal to the angle of the major axis of the cleats to the border portion 24.

The above-described cleat arrangement provides hard floor creep performance about equal to a flat-back design but has significantly better creep performance than the small cleats abundantly used on current dust control mats. In addition to the improved migration performance, the new cleat pattern provides cleats of much larger size with significantly less cleats being required and increases the friction resistance between the mat and a wet floor similar to the action of the treads of an automobile tire on a wet road. This results in a less aggressive scrubbing action against the mat pile during laundry processing in the washwheel and significantly reduced linting. Further, the rubber molding pads now become much easier to fabricate and it is thought that they can be produced on a simple rotary die cutter rather than the costly vertical die cutting procedure now being used. The resulting pads should also be much more resistant to tearing due to the greater spacing between cleats.

Although the preferred embodiment of the invention has been specifically described, it is contemplated that changes may be made without departing from the scope or spirit of the invention and it is desired that the invention be limited only by the claims.

I claim:

1. A dust control mat comprising: a pile fiber upper surface, a rubber-like backing surface having a border therearound connected to said upper surface and a plurality of sets of cleats attached to the side of said backing surface away from said upper surface, one set of cleats having a plurality of elliptical shaped cleats in a plurality of rows with each cleat having its major axis at angle to said border, each of said elliptical shaped cleats in each row being substantially parallel to the other elliptical shaped cleats in said row and substantially perpendicular to the elliptical shaped cleats in the next adjacent rows, a second set of cleats smaller than said elliptical cleats being located in each row between each of said elliptical cleats in said rows.

2. The mat of claim 1 wherein all of said cleats are integral with said backing surface.

3. The mat of claim 2 wherein said second set of cleats includes a plurality of substantially circular members between each of said elliptical cleats in each row.

4. The mat of claim 1 wherein, the length of said elliptical cleats along the major axis thereof is substantially five times the width of said elliptical cleats.

5. The mat of claim 4 wherein each of said elliptical cleats are at an angle of approximately 45° with said border.

6. The mat of claim 5 wherein the length of said cleats along the major axis thereof is substantially five times the width of said cleats.

7. A dust control mat comprising: a pile fiber upper surface, a rubber-like backing surface having a border therearound connected to said upper surface and a plurality of sets of cleats attached and integral to the side of said backing surface away from said upper surface, one set of cleats having a plurality of elliptical shaped cleats in a plurality of rows with each cleat having its major axis at angle to said border, each of said elliptical shaped cleats in each row being substantially parallel to the other elliptical shaped cleats in said row and substantially perpendicular to the elliptical shaped cleats in the next adjacent rows, a plurality of circular cleats smaller than said elliptical cleats being integral to said backing surface and located in each row between each of said elliptical cleats in said rows, said circular cleats in each row lying in a plane substantially parallel to the major axis of the adjacent elliptical cleats.

8. The mat of claim 7 wherein the rows of circular members in each row is substantially equidistant from the next adjacent elliptical cleat in the same row.

9. The mat of claim 8 wherein the number of circular members in each row between each elliptical cleat is six.

* * * * *